US006503149B2

(12) United States Patent
Jelinek

(10) Patent No.: US 6,503,149 B2
(45) Date of Patent: Jan. 7, 2003

(54) SWING TRAINING AND PRACTICE DEVICE

(76) Inventor: Ross Jelinek, 3422 N. 11th St. #3, Sheboygan, WI (US) 53083

( * ) Notice: Subject to any disclaimer, the term of this patent is extended or adjusted under 35 U.S.C. 154(b) by 0 days.

(21) Appl. No.: 09/876,623

(22) Filed: Jun. 7, 2001

(65) Prior Publication Data

US 2002/0187847 A1 Dec. 12, 2002

(51) Int. Cl.[7] ..... A63B 69/36
(52) U.S. Cl. ..... 473/224; 473/219; 473/234
(58) Field of Search ..... 473/224, 219, 473/234, 256

(56) References Cited

U.S. PATENT DOCUMENTS 4,953,868 A * 9/1990 Thompson et al.
5,405,138 A * 4/1995 Duran
5,551,694 A * 9/1996 Grim, Jr. et al.
5,577,966 A * 11/1996 Duran
5,807,183 A * 9/1998 Benson
D405,859 * 2/1999 Thompson
5,865,686 A * 2/1999 MacGregor
D426,607 * 6/2000 Wurster

* cited by examiner

*Primary Examiner*—Raleigh W. Chiu
*Assistant Examiner*—Nini F. Legesse
(74) *Attorney, Agent, or Firm*—Dennis A. Gross; The Hill Firm

(57) ABSTRACT

A swing training and practice device for sports such as golf consisting of a length of substantially rigid hollow tubing having a grip at one end and a weight at the other end with a convoluted tube positioned interior of the substantially rigid tube extending into the length of the tube from adjacent the weighted end. The device, when swung produces an audible tone, the characteristics of which vary with the speed and trajectory of the swing. Production of a repetitive, constant tonal pattern thus indicates consistency of swing.

9 Claims, 1 Drawing Sheet

10
11
12
13
15
16
18
19
20
21
25
28
30°
45°
II
III
IV

SWING TRAINING AND PRACTICE DEVICE

FIELD OF THE INVENTION

This invention relates to sports training and practice devices and in particular to an audible tone generating gripped shaft having a convoluted interior tube.

BACKGROUND OF THE INVENTION

Many sports involve the swinging of a grip ended instrument such as a tennis racket, baseball bat, or golf club. One component of training can be the development of a consistent swing, however aside from feel and results, it is difficult for an individual to determine whether or not his or her swing is being reproduced consistently. While a wide variety of training aids have been developed and proposed, in general such devices are not specifically directed to consistent repeatability of swing. For example, in connection with golf training devices, the prior art has generally been more concerned with assisting the golfer in striking the ball correctly, a impact condition existing at the moment of contact between the club head and the ball. While such training takes into consideration factors such as direction, angulation and position, club speed and the consistency of swing are generally not measured. Devices such as that shown in U.S. Pat. No. 5,916,037 emphasize the desirability of training for obtaining consistent swing, however rely on body position devices. Other devices which rely upon audible indicators are designed to produce a single sound such a click when particular swing conditions are met such as that shown in U.S. Pat. No. 3,575,419. While it has been recognized that elongated devices when moved through the air can produce a sound, such devices are inappropriate for training of swing either because they are flexible and therefore unlikely to be consistent in sound, such as shown in U.S. Pat. Nos. 5,405,138; 5,395,278 and 4,034,499 or because they failed to provide the proper feel and weight of a sports implement.

It would therefore be an advance in the art to provide a sound producing sports swing training and practice device where consistency of swing produces a consistent repeatable audible toned pattern during the swing and where the device can be adapted to provide an appropriate weight and feel for the designated sport.

SUMMARY OF THE INVENTION

My invention provides an improved swing training and practice device which consists of a substantially rigid tube which may be configured for the appropriate sport to resemble, in length, different sports devices such as a tennis racket, a baseball bat or a golf club and which is provided with a grip at one end appropriate to the sports instrument and a weight adjacent the opposite end appropriate to the weight and balance of a representative sample of the sports instrument. The tube is hollow and contains interior thereof, a corrugated tube such as an accordion pleat tube. The corrugated tube is positioned adjacent the weighted end and extends along the length of the substantially rigid tube a distance sufficient to provide a sound when the rigid tube is swung. The pitch of the sound is believed to be determined primarily by the length and corrugation dimensions of the interior tube together with the length of the semi-rigid tube. The tubes combine to provide a substantial sound which changes in its characteristics such as frequency (pitch) and/or amplitude (loudness) dependant upon the speed of movement of the device through the air. Because of the different speeds, the audible signal detected by the user's ear varies during the course of the swing. By repeated practice to produce a constantly reproduced sound pattern from onset of swing through point of desired impact, the user can learn a natural"grooved" swing producing the maximum natural speed at the presumed point of impact.

In an embodiment of the invention, a golf swing training and practice device is provided having an over all length of approximately 37 in., having a grip area of normal golf club grip dimensions at one end and a weight collar positioned adjacent the other end. The device can preferably be made of substantially rigid tubing such as PVC tubing. The interior is hollow and contains an inner tube of commercially available corrugations. This flexible tube extends from adjacent the weighted end to adjacent the distal end of the grip section and has an inner diameter approximately the same as the end openings at the grip end and the weighted end. When swung the device produces an audible sound which increases in intensity with the speed of the swing.

In a further embodiment, the corrugated flexible tube is surrounded by a spacer extending between the outer diameter of the corrugated flexible tube and the inner diameter of the substantially rigid tube and which contacts the tubes at a plurality of circumferentially spaced points.

In another embodiment, the training device consists of a plurality of substantially rigid hollow elongated sections joined permanently together and including an end section provided with a grip appropriate for the sports implement being approximated, an elongated section extending from the grip section having a substantially constant inner diameter and receiving a flexible corrugated hose member in a relatively uncompressed state terminating adjacent an open distal end of the elongated member with the distal end of the elongated member being fitted with exterior weight adjusting substantially rigid members.

Various features and objects of the invention will be explained in greater detail in the preferred embodiment described hereinafter.

DETAILED DESCRIPTION OF THE PREFERRED EMBODIMENT

Figures 1, 2, 3, 4:
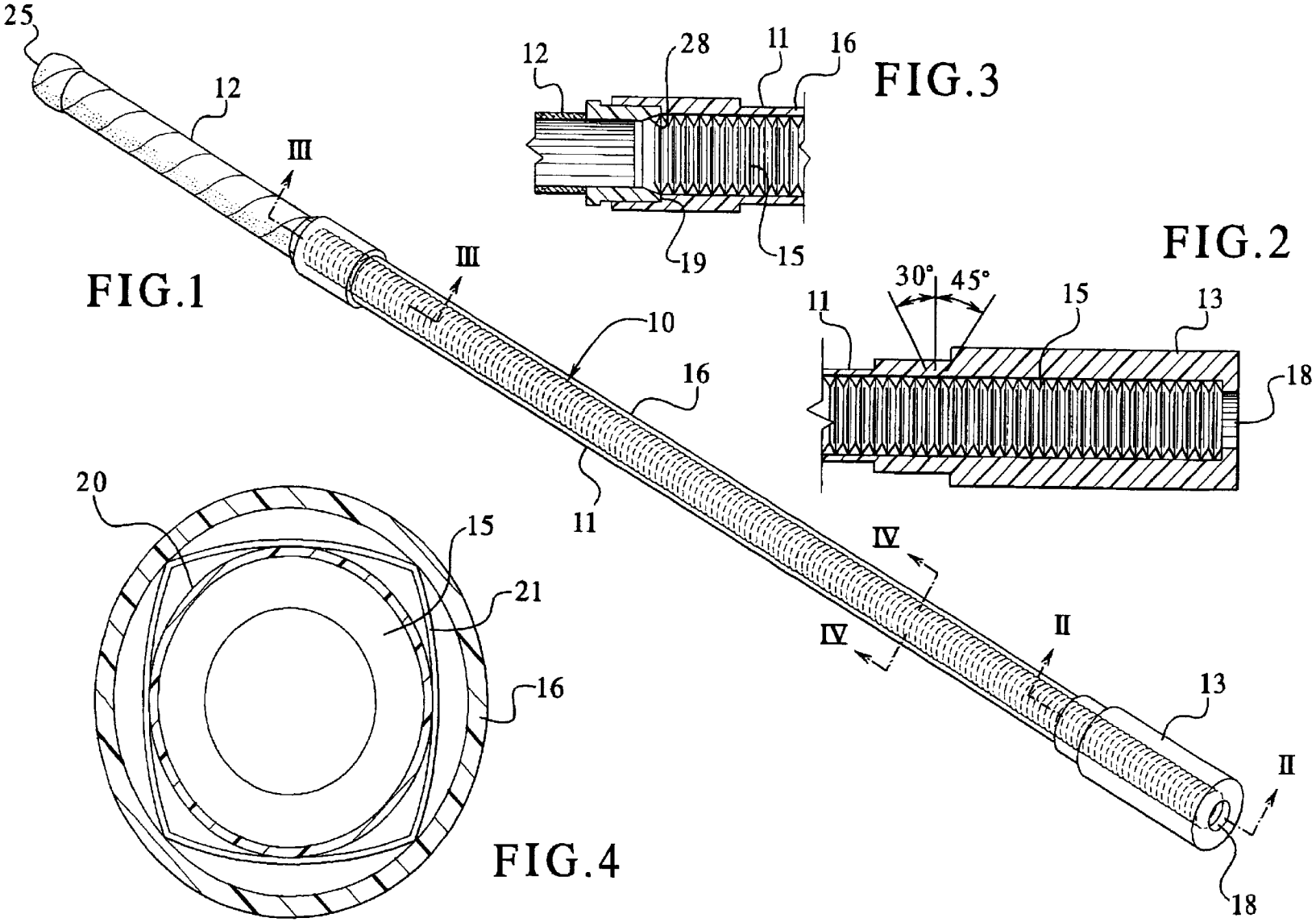
FIG. 1 is a perspective a golf club swing training and practice device according to this invention.
FIG. 2 is a fragmentary cross sectional view of the distal end.
FIG. 3 is a fragmentary cross sectional view of the grip end of the golf training device.
FIG. 4 is a cross sectional view of the golf training device taken along the lines of IV of FIG. 1.

The swing training and practice device is illustrated in FIG. 1 in connection with a golf swing trainer 10 consisting of a substantially rigid elongated hollow tube 11 which may, for example, be formed of commercially available ¾ in. thin walled PVC pipe. The training device 10 may have an over all length approximating the length of the golf club, for example approximately 37 in. for a mid range club such as, for example, a five iron. In other embodiments the tube 11 can be shaped to simulate other sports equipment such as a baseball bat or the like. For shorter handled sports equipment, such as tennis rackets, the length of the tube portion 11 may exceed the length of the normal handle in order to facilitate the production of the audible noise as more fully explained hereinafter.

In the preferred embodiment illustrated, a proximal end portion 12 is provided with a grip substantially normal to golf club grips. A distal end portion 13 is provided with a weight formed around the outside of the trainer designed to approximate club head weight appropriate to the club being simulated. Although the weight is illustrated as being substantially cylindrical, it will be understood that the weight can be shaped to simulate a club head if desired thereby simulating normal air resistance and weight positioning. Importantly, the swing trainer 10 is hollow from the proximal end to the distal end with the end openings 25, 18 having a diameter substantially the same as the minor inner diameter of a convoluted interior tube 15, best shown in FIGS. 2 and 3. The convoluted inner tube may be a thin walled plastic accordion pleated tube of the type commercially available for use as air hoses in medical equipment. For a ¾ in. thin walled PVC pipe I have found that a appropriate convoluted hose may be 15 mm expandable tubing from Cleveland tubing of Cleveland, Tenn.

The convoluted hose or tube 15 is positioned interior of the tube 11 in a naturally expanded condition whereby the spacing between the convolutions is the normal elongated spacing for the uncompressed tubing and in a preferred embodiment may be approximately 3⁄16 in. peak to peak. As shown in FIG. 3, the slope faces of each peak may be of different angles to a line normal to the hose axis. For example, the slope of the walls on the grip side of the minor diameter may be 30°, while on the distal side they may be 45°. The convoluted hose or tube extends the length of the shaft portion of the tube 11 from adjacent the distal end opening to adjacent the junction between the grip section 12 and the mid shaft portion 16 of tube 11. For a golf club having a length of approximately 37 in. the length of the convoluted hose will be approximately 28 in. The distal end opening 18 of the tube 11 has a diameter reduction formed by an end cap such that the opening is approximately the same diameter as the minor ID of the convoluted hose 15 thereby retaining the convoluted hose interior of the substantially rigid tube 11. A similar diameter 28 reduction can be provided at the grip-intermediate section junction 19 where, however, the diameter reduction may be tapered such that the convoluted inner tube rests substantially freely interior of the intermediate section 16 of tube 11.

Convoluted hose or tubing desirably exhibits axial resilient compressability such that a hose 15 may be received between the diameter reductions in a slightly compressed state. Preferably the convoluted tube 15 will have a major outer diameter approximately equal to the inner diameter of the section 16 of tube 11. As shown in FIG. 4, where the interior diameter of the tube section 16 is greater than the major outer diameter 20 of the convoluted hose, a spacer 21 may be provided to retain the hose 15 substantially coaxially within tube section 16. Although the spacer may be solid, where this would add undesired weight to the shaft, I have found that a thin spacer contacting the shaft portion 16 inner diameter at circumferentially spaced points and contacting the convoluted hose 15's outer diameter at other circumferentially spaced points provides adequate support for the hose 15 while maintaining general coaxial relationship between the hose 15 and tube 16. In the preferred embodiment, the convoluted hose will rest against both diameter restrictions at the distal end and at the grip-outer tube juncture and to assure this occurs it is acceptable to slightly compress the normal expanded length of the convoluted hose, preferably, however without collapsing the accordion pleats. I have found that by assuring contact with both diameter reductions that sound production is enhanced although the device will produce sound when the corrugated tube is shorter in length than the distance between the diameter reductions.

It will be appreciated that use of a substantially rigid outer tube coupled with a separate, more flexible corrugated inner tube or hose greatly facilitates the sports-like feel of the structure. Commercially available corrugated tubing or hosing is insufficiently rigid to provide the desired"stiffness" to simulate a golf club, baseball bat or the like.

In practice, the swing training and practice device is swung in the normal manner for the sport. In the illustrated preferred embodiment the swing trainer 10 is swung like a golf club and as the distal end moves through the air, at normal speeds from approximately 50 to 150 mph, a whistle sound is produced. This sound is proportional in intensity to the speed of movement of the distal end with sound characteristics audible to the user varying from the onset of the swing through conclusion of the swing. By adjustment of the swing it will be possible to assure that the maximum perceived sound or noise level occurs at the point of the swing where the club head would normally contact the golf ball. By repetitive practice utilizing the swing trainer, a user can learn to"groove" the swing so that the point of maximum perceived noise signal repetitively occurs at the desired impact point of the swing trajectory. Swinging the swing trainer provides the user with an audible cue to the speed of the swing at every position during the swing. Knowing where the ball is to be, and hearing when the most notable sound is produced by the swing, leads the user to reconcile any differences and to adjust the swing so that the point of most notable sound occurs when the distal end is at the point of impact. By repeated training with the swing trainer, the user is able to develop a consistent swing maximizing club head speed at the desired point.

This invention can be modified to many different sports, for example to a baseball swing where the shaft tube 11 may be reshaped to resemble a normal baseball bat with the grip end portion 12 similarly formed as a baseball bat end.

Although I have described my invention in connection with a specific preferred embodiment, namely a golf club simulator, it will be understood that others may desire to utilize my invention in connection with different devices, or devices having different shapes, lengths, diameters, tubes and the like. These and other alternatives are considered equivalents and within the scope of the present invention.

What is claimed is:

1. A noise producing swing training and practice device comprising an elongated substantially rigid hollow body having distal and proximal ends, openings to the hollow body at both the distal and proximal ends, an inner diameter convoluted tube received entirely interior of the body, the tube having a length between its ends extending from adjacent the distal end opening of the body towards the proximal end opening, the length received entirely within the body, the device producing an audible signal as the distal end is swung through the air from the proximal end.

2. The device of claim 1 wherein the body has a grip portion at the proximal end and a weight adjacent the distal end.

3. The device of claim 1 wherein the convoluted tube is an accordion pleated tube having circumferential major and minor diameters spaced along the axial length of the tube.

4. The device according to claim 3 wherein the convoluted tube has a minimum inner diameter approximately equal to the diameter of the openings at the distal and proximal ends.

5. The training device of claim 4 wherein the convoluted tube extends towards the proximal end from adjacent the distal end and terminates in spaced relationship from the proximal end opening.

6. The device of claim 5 wherein the convoluted tube is slightly compressed within the hollow body and positioned between body portions having inner diameters less than a major out diameter of the convoluted tube and wherein the body surrounds a tubular axial opening.

7. The device according to claim 5 wherein the tube is smaller in outer diameter than the axial opening and a spacer extends between the wall of the opening and the tube.

8. A noise producing swing training and practice device comprising an elongated substantially rigid hollow body having distal and proximal ends with an axial opening extending between the ends open at both ends, a gripping portion on the outer surface of the body adjacent the proximal end and a weight adjacent the distal end, a convoluted inner surface formed on a separate body insert positioned entirely within the body and having a length extending a substantial portion of the distance of the body opening from adjacent the distal end towards the proximal end, the insert not projecting exterior of the body, the device producing an audible signal as the distal end is swung through the air.

9. The device according to claim 8 wherein the convoluted surface is provided by an accordion pleaded tube received in the opening having circumferential pleats.

* * * * *